US006679652B2

(12) United States Patent
Suriano

(10) Patent No.: US 6,679,652 B2
(45) Date of Patent: Jan. 20, 2004

(54) CONCRETE FINISHING TOOL

(76) Inventor: Anthony J. Suriano, 24 W. 146th Saint Charles Rd., Carol Stream, IL (US) 60188

( * ) Notice: Subject to any disclaimer, the term of this patent is extended or adjusted under 35 U.S.C. 154(b) by 0 days.

(21) Appl. No.: 10/178,852

(22) Filed: Jun. 25, 2002

(65) Prior Publication Data

US 2003/0031510 A1 Feb. 13, 2003

Related U.S. Application Data

(60) Provisional application No. 60/310,251, filed on Aug. 7, 2001.

(51) Int. Cl.[7] ..... E04F 21/16
(52) U.S. Cl. ..... 404/97
(58) Field of Search ..... 404/97, 118, 120, 404/101, 72

(56) References Cited

U.S. PATENT DOCUMENTS

| | | | | | |
|---|---|---|---|---|---|
| 1,424,291 | A | * | 8/1922 | Frank | 7/170 |
| 2,581,141 | A | * | 1/1952 | Raptis | 15/144.2 |
| 2,962,946 | A | * | 12/1960 | Neff | 404/101 |
| 3,090,066 | A | | 5/1963 | Ferrell, Jr. et al. | |
| 3,162,881 | A | | 12/1964 | Negwer | |
| 3,729,765 | A | | 5/1973 | Peterson | |
| 4,520,527 | A | | 6/1985 | Maggio et al. | |
| 4,702,641 | A | * | 10/1987 | Naser et al. | 404/97 |
| 4,752,154 | A | * | 6/1988 | Valentine | 404/72 |
| 4,759,658 | A | | 7/1988 | Manor | |
| 4,856,932 | A | | 8/1989 | Kraft | |
| 4,882,802 | A | | 11/1989 | LeVere, Jr. | |
| 4,892,437 | A | | 1/1990 | Kraft | |
| 5,123,138 | A | | 6/1992 | Flamm | |
| 5,393,168 | A | | 2/1995 | Jarvis | |
| 5,502,859 | A | * | 4/1996 | Kim | 15/144.1 |
| 5,549,413 | A | | 8/1996 | Bolden | |
| 5,638,656 | A | | 6/1997 | Roe | |
| 5,687,448 | A | | 11/1997 | Dye, Jr. | |
| 6,088,865 | A | * | 7/2000 | Truan et al. | 15/78 |
| D433,819 | S | * | 11/2000 | Thunderchild | D4/132 |
| 6,227,750 | B1 | | 5/2001 | Maggio et al. | |

FOREIGN PATENT DOCUMENTS

| | | |
|---|---|---|
| GB | 2189282 | 10/1987 |
| GB | 2231075 | 11/1990 |

* cited by examiner

*Primary Examiner*—Robert E. Pezzuto
*Assistant Examiner*—Raymond W Addie
(74) *Attorney, Agent, or Firm*—Richard C. Litman

(57) ABSTRACT

A concrete finishing tool includes a float and texturing brush installed upon the distal end of an elongate handle. The float and handle connection may include a mechanism for adjusting the plane of the float relative to the handle axis, if desired. A pair of brackets extends from the upper surface of the float, with a texturing broom or brush adjustably secured to the distal ends of the brackets. The brackets allow the broom to be adjusted linearly and/or angularly relative to the plane of the float, to provide a bristle rake angle and/or penetration depth as desired. The finishing tool, with its adjustable texturing broom, allows a concrete worker to begin texturing a freshly poured concrete surface as it is being smoothed, with the worker adjusting the broom for a consistent finish texture as the concrete changes its viscosity during the curing process.

14 Claims, 3 Drawing Sheets

CONCRETE FINISHING TOOL

CROSS-REFERENCE TO RELATED APPLICATION

This application claims the benefit of U.S. Provisional patent application Ser. No. 60/310,251, filed Aug. 7, 2001.

BACKGROUND OF THE INVENTION

1. Field of the Invention

The present invention relates generally to manually operated finishing tools and equipment, and more particularly to a concrete finishing tool having a "float" or trowel in combination with a texturing broom or brush. The height and angle of the broom bristles are adjustable relative to the float, to allow the user to adjust the pressure of the bristles according to the state of cure of the freshly poured and finished concrete and desired finish texture. Concrete may be smoothed and textured in one operation, using the present tool.

2. Description of the Related Art

Concrete is commonly used for forming roads, highways, driveways, floor slabs, sidewalks, etc., where a relatively smooth and hard, durable material is required. While concrete is a relatively inexpensive material for such applications, it nevertheless requires a certain amount of work after pouring.

When the concrete is initially poured, it must be smoothed or leveled to the desired degree while still in its wet or uncured state. This is conventionally accomplished using a long handled appliance with a relatively large trowel or "float" on the distal end thereof, whereby a worker can smooth a relatively large expanse of concrete from one edge or side of the freshly poured slab. Such tools generally provide articulation between the handle and the float, allowing a worker to adjust the angle of the float relative to the handle by twisting the handle. This allows the worker to keep the float level with the surface of the concrete, while changing the angle between the extension handle or pole and the float to adjust for different distances between the worker and the float.

However, a perfectly smooth surface may not be desirable in many applications, as such a surface provides relatively low friction for vehicle or pedestrian traction. Accordingly, it is a common procedure to use a broom or brush to produce some texture to the concrete after it has been smoothed with a float or trowel. Heretofore, this has generally been accomplished as a separate operation from the smoothing and leveling operation, using a separate tool. A relatively long pole or handle is provided with a relatively wide broom or brush at its distal end, somewhat like a conventional push broom. However, the lack of adjustability of such a device often creates various problems and difficulties during this brushing or texturing operation.

First of all, it is often necessary to delay the brushing or brooming operation for some time after the concrete surface has been leveled and smoothed, in order for the concrete to set to the required consistency for brooming. Attempting to broom the surface too soon after the concrete has been poured, can often lead to excessively deep and coarse brush marks in the surface, which are unacceptable. Thus, in order to avoid this problem, concrete finishing workers may be idle for some period of time, waiting for the concrete to cure to the desired state before they can continue work with the brooming or texturing operation. Obviously, this is not cost effective.

Secondly, the concrete continues to cure as time passes. While the concrete may have a nearly ideal viscosity when the brooming or brushing operation commences, the concrete continues to cure during the operation. This results in dissimilar textures being applied to different areas of the slab, if some time passes from the beginning to the end of the brooming operation. With conventional concrete brooms or brushes, there is little that can be done to avoid these problems.

Accordingly, a need will be seen for a concrete finishing tool which is a combination of a concrete float, used for smoothing and leveling the concrete after pouring, and a broom or brush, used for providing the desired texture to the concrete after the smoothing and leveling operation. The present combination tool provides both float and broom, and moreover, provides adjustability for the rake angle of the bristles and the broom height relative to the float.

The present concrete finishing tool thus allows a concrete worker to smooth and level a freshly poured concrete surface, and immediately proceed with brushing or texturing the surface using the broom attached to the combination tool. The brush or bristles may be adjusted for relatively shallow penetration and rake angle, to allow a worker to texture relatively fresh and wet concrete essentially immediately after it has been leveled and smoothed. As time progresses and the concrete begins to cure, the brush may be adjusted to extend further below the level of the float, and/or the brush angle may be adjusted for a more vertical rake angle, in order to brush the concrete more firmly as it sets up and cures. The present finishing tool thus allows a concrete worker to continue finishing and texturing work without need to wait for the concrete to reach a certain stage or degree of cure before proceeding, thus keeping the workers continuously employed and reducing the time and cost required for the job.

A discussion of the related art of which the present inventor is aware, and its differences and distinctions from the present invention, is provided below.

U.S. Pat. No. 3,090,066 issued on May 21, 1963 to Lawrence H. Ferrell, Jr. et al., titled "Cement Slab Finishing Device," describes a tool having an elongate handle or pole with an angularly adjustable finishing blade or trowel at the distal end thereof. Two different means of remotely adjusting the trowel angle relative to the handle, are disclosed. However, Ferrell, Jr. et al. do not provide any form of texturing brush or broom.

U.S. Pat. No. 3,162,881 issued on Dec. 29, 1964 to Walter G. Negwer, titled "Adjustable Bull Float," describes a long handled float having a remotely adjustable angle between float and handle. While the Ferrell, Jr. et al. adjustable float utilizes the rotation of a central rod which passes through the handle to actuate the adjustment, Negwer utilizes the rotation of the handle itself. Negwer provides a link between handle and float, with the link having a spiral shape. As the handle is twisted, the radius defined between the link attachment at the float and its handle attachment varies, thereby adjusting the angle between float and handle. However, Negwer does not provide a concrete texturing or finishing broom or brush in combination with his adjustable float.

U.S. Pat. No. 3,729,765 issued on May 1, 1973 to William D. Peterson, titled "Self-Tilting Trowel For Concrete," describes a trowel or float which attaches to the distal end of the handle by means of a set of angled slots which ride on corresponding pins extending laterally from the handle end. As forward pressure is applied to the trowel or float by the handle, the float shifts rearwardly, with the angled slots resulting in the leading edge of the float lifting and the trailing edge lowering. As the handle is pulled rearwardly, the float shifts in the opposite direction on the pins, with opposite edges being raised and lowered. Thus, the leading or advancing edge of the float is always raised slightly, to avoid digging into the fresh concrete. However, Peterson does not disclose any form of broom or brush in combination with his self-tilting trowel.

U.S. Pat. No. 4,520,527 issued on Jun. 4, 1985 to Richard A. Maggio et al., titled "Concrete Finishing Tool," describes a tool having an angularly adjustable trowel or float at the distal end of the handle, loosely similar to the earlier tools described above. Maggio et al. recognize the importance of keeping the float level during finishing work, and provide an excellent explanation of the process in the background of the invention of their issued patent. The Maggio et al. device utilizes an eccentric link between the distal end of the handle and the trowel or float, with the handle being otherwise free to rotate relative to the float. Thus, when the handle is twisted, the eccentric link raises or lowers the edge of the float opposite its pivotal attachment point with the handle end. This arrangement is similar to the "Hustler Head" configuration commonly used in concrete tools, for adjusting the angle of the float relative to the handle. However, Maggio et al. fail to provide any broom or brush attachment for their tool.

U. S. Pat. No. 4,752,154 issued on Jun. 21, 1988 to Roy L. Valentine, titled "Concrete Finishing Tool And Method," describes a combination concrete trowel or float and brush or broom extending therefrom. The trowel is angularly adjustable relative to the elongate handle, by means of a "Hustler" bracket (column 2, lines 57–58). However, the brush is attached directly and immovably to the float or trowel, and cannot be adjusted or articulate relative to the float or trowel. The present finishing tool provides means for adjusting the depth and rake angle of the brush or broom relative to the float or trowel.

U.S. Pat. No. 4,759,658 issued on Jul. 26, 1988 to Jonathan W. Manor, titled "Concrete Finishing Broom," describes a concrete finishing broom head, having a configuration similar to that of a conventional push broom or the like. Manor provides various means of attaching pull lines to the broom head, so the head may be pulled across a fresh concrete surface alternately from opposite sides. Manor does not provide any form of rigid handle, nor does he provide a finishing float in combination with his broom head, as provided by the present concrete finishing tool invention.

U.S. Pat. No. 4,856,932 issued on Aug. 15, 1989 to Simon Kraft, titled "Concrete Finishing Float Having Spirally Slotted Sleeve," describes another mechanism for adjusting the angle of the float relative to the pole or handle of the tool. Kraft provides a distal outer tube with a spiral slot formed therein, with the distal end of the handle passing through the outer tube. A lateral bolt or pin is fixed in the distal end of the handle, and rides in the slot of the outer tube or sleeve. Twisting the handle causes the sleeve to move longitudinally relative to the pole. A link extends between the sleeve and an attachment on the float, with the float pivoting about an attachment to the distal end of the pole or handle. While this means of articulating the float relative to the handle may be used in lieu of other mechanisms described further above, Kraft does not provide any broom or brush attachment to his float, as provided by the present concrete finishing tool invention.

U.S. Pat. No. 4,882,802 issued on Nov. 28, 1989 to Chester C. LeVere, Jr., titled "Versatile Construction Broom Holder," describes a bracket having a single upstanding lug which attaches between the distal end forks of a handle or pole. The remainder of the bracket comprises a generally U-shaped fitting which adjustably attaches around the spine of the broom. LeVere, Jr. does not provide any means of securing a concrete trowel or float to the end of the handle, with his broom or brush.

U.S. Pat. No. 4,892,437 issued on Jan. 9, 1990 to Simon Kraft, titled "Concrete Finishing Float With Rear Fitting Bar," describes a tool having arcuate adjustment between the handle and float, with the adjustment comprising an eccentric link between handle and float. The Kraft '437 device is similar to the device of the Maggio et al. '527 U.S. Patent discussed further above, with the exception that Kraft places the link on the opposite side of the float attachment pivot to the pole or handle. In any event, no brush or broom attachment is disclosed in the Kraft '437 U.S. Patent.

U.S. Pat. No. 5,123,138 issued on Jun. 23, 1992 to Brent Flamm, titled "Scraper Broom," describes an assembly for attaching a scraper blade and a broom head to the end of a pole or handle. A pair of angle stock pieces are attached to a ferrule, with one of the angles providing attachment for a scraper blade, and the other providing attachment for a broom head. The components are rigidly and immovably secured to one another and to the ferrule, with no angular or other adjustment of any components being possible.

U.S. Pat. No. 5,393,168 issued on Feb. 28, 1995 to Jack D. Jarvis, titled "Device For Connecting An Elongated Handle To A Bull Float Plate," describes yet another means for angularly articulating the float relative to the pole or handle. Jarvis provides a gearbox at the juncture of the pole and float attachment, with a pair of mating gears (crown and spur, etc.) resulting in angular pivoting of the float relative to the handle when the handle is rotated slightly. While the present invention may make use of such an angular float adjustment means, as well as any other, the device of the Jarvis U.S. Patent differs from the present invention in that Jarvis does not provide any broom or brush attachment for his float.

U.S. Pat. No. 5,549,413 issued on Aug. 27, 1996 to Gary A. Bolden, titled "Multi-Use Concrete Finishing Apparatus," describes a frame for holding two spaced apart concrete brooms or brushes. The broom pair is dragged across the concrete in alternating directions by opposed workers, by ropes extending to each side thereof. The Bolden device is thus more closely related to the device of the Manor '658 U.S. Patent discussed further above, than to the present invention. While it is noted that Bolden provides means for attaching one of his broom heads to the distal end of a rigid pole, Bolden does not disclose any incorporation of a concrete float or trowel with such a broom head attachment, which adjustable combination is a part of the present concrete finishing tool invention.

U.S. Pat. No. 5,638,656 issued on Jun. 17, 1997 to Clifton L. Roe, titled "Concrete Smoothing Apparatus," describes various embodiments of a concrete broom or brush tool or assembly. One embodiment comprises a pair of spaced apart broom heads which are pulled back and forth across the concrete. This embodiment more closely resembles the device of the Bolden '413 U.S. Patent than it does the present invention. In another embodiment, one of the brooms may be replaced by a fresno (concrete smoothing trowel or float). However, Roe does not provide any means for installing both a float and a broom head on the distal end of a single rigid pole, nor does he provide any means for adjusting the height or rake of the broom head relative to the float in such an installation, both of which means are a part of the present invention.

U.S. Pat. No. 5,687,448 issued on Nov. 18, 1997 to Walter C. Dye, Jr., titled "Adjustable Cement Finishing Tool," describes a float and handle attachment allowing the worker to lock the two elements relative to one another to prevent relative pivotal movement therebetween, as desired. A threaded stud extends from a pivot block and engages the distal end of the handle or pole. Turning the pole to tighten its engagement with the stud, causes the end of the pole to bear against the pivot block and frictionally lock the two components together. Loosening the pole or handle permits the assembly to pivot. However, Dye, Jr. makes no disclosure of any additional attachments (broom, etc.) for his assembly, as provided by the present concrete finishing tool.

U.S. Pat. No. 6,227,750 issued on May 8, 2001 to Leonard C. Maggio et al., titled "Universal Adjustable Angle Bracket For Concrete Leveling And Finishing Tools," describes an eccentric arm extending from the distal end of the handle pole, and attaching to the float to cause the float to articulate angularly when the pole is twisted. The device is thus closely related to the device of the Maggio et al. '527 U.S. Patent to the same inventors, discussed further above. As in the '527 U.S. Patent, no disclosure is made of any broom or brush attachment to the device, nor for any means of adjusting such an assembly, as provided by the present concrete finishing tool invention.

British Patent Publication No. 2,189,282 published on Oct. 21, 1987 to Marshalltown Trowel Company, titled "Concrete Finishing Float," describes a float and handle attachment assembly having two parallel pairs of links, with the two links of each pair defining an angle therebetween. Pushing and pulling on the handle results in the float shifting forwardly and rearwardly relative to the handle, with the links driving whichever edge is the trailing edge downwardly relative to the opposite leading edge, depending upon the direction of travel. The Marshalltown Trowel device thus bears a closer resemblance to the device of the Peterson '765 U.S. Patent, discussed further above, than to the present concrete finishing tool invention.

Finally, British Patent Publication No. 2,231,075 published on Nov. 7, 1990 to Anthony B. McMahon, titled "Concrete Leveling Tool," describes a concrete float having an oval shape, with rounded ends. McMahon makes no disclosure of any means for attaching another tool (concrete broom or brush, etc-) to his concrete float, with there accordingly being no disclosure of any means for the adjustment of such an attachment relative to the float, as provided in the present concrete finishing tool.

None of the above inventions and patents, either singly or in combination, is seen to describe the instant invention as claimed.

SUMMARY OF THE INVENTION

The present invention comprises a concrete finishing tool having a smoothing or finishing trowel or float and texturing broom or brush together in combination. The assembly is arcuately or pivotally secured to the distal end of an elongate handle or pole by a "Hustler Head" mechanism or the like, whereby twisting the handle or pole changes the angle between the plane of the float and the axis of the handle pole. A texturing broom or brush is removably attached to the top of the float by a pair of brackets, with the brackets providing angular and linear adjustment of the rake angle and bristle height of the brush relative to the float. This allows the concrete worker to adjust the broom as desired to produce a consistent surface finish to the concrete, regardless of the specific wetness or viscosity of the fresh concrete, so long as the concrete may still be worked.

Accordingly, it is a principal object of the invention to provide a concrete finishing tool comprising a float and texturing broom in combination, assembled upon the distal end of a single elongate handle or pole.

It is another object of the invention to provide such a concrete finishing tool including means for adjusting the angle between the plane of the float and the axis of the handle, as desired.

It is a further object of the invention to provide such a concrete finishing tool including plural brackets extending from the upper surface of the float, for attachment of the texturing broom or brush thereto.

Still another object of the invention is to provide such a concrete finishing tool wherein the brush attachment bracket provides linear and angular adjustability for the brush or broom relative to the float.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a concrete finishing tool, comprising a combination smoothing and finishing trowel or "float" and adjustable surface texturing brush in a single tool. An elongate handle is used to work and maneuver the tool as desired, with the handle and its attachment to the float and brush assembly including means for adjusting the angle of the float relative to the handle.

Figure 1:
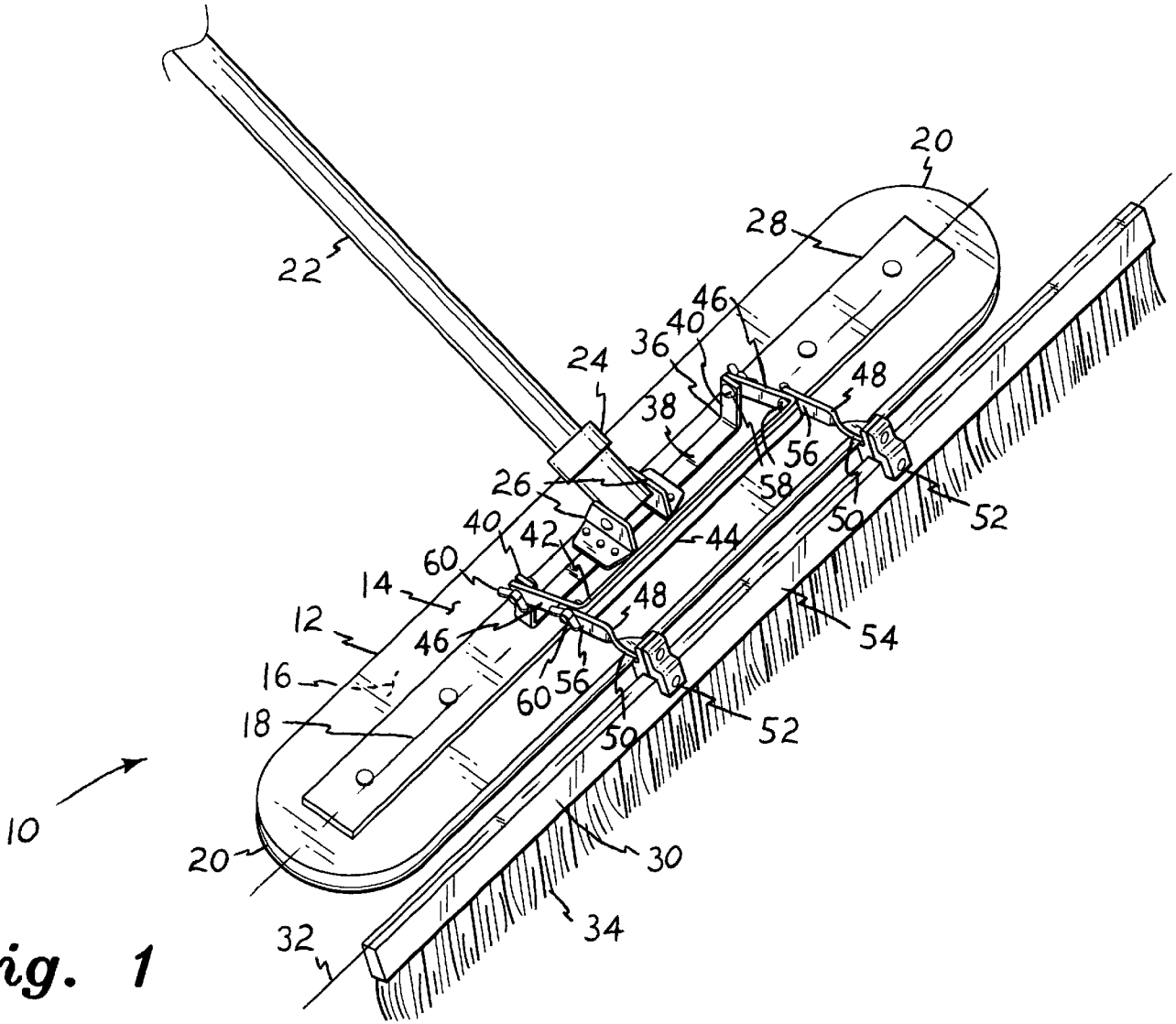
FIG. 1 is a perspective view of a concrete finishing tool according to the present invention with the handle broken away, showing the general configuration and features of the working end.

FIG. 1 of the drawings illustrates a top perspective view of the present concrete finishing tool 10. The tool 10 includes a wide, flat, and rigid concrete spreading and smoothing trowel or float 12, having an upper surface 14, an opposite lower surface 16, and an elongate lateral axis 18. The float 12 may have any practicable planform (rectangular, etc.), but may also have an oval shape with rounded opposite ends 20, as shown in FIG. 1. Such rounded corners and/or ends are preferable, in order to avoid ridges and other discontinuities in the fresh concrete surface as the trowel is worked thereacross.

An elongate handle 22 has a float attachment end 24 secured generally medially to the upper surface 14 of the float, by suitable brackets 26. Additional reinforcement may be provided by a laterally spanning plate 28 extending the majority of the width of the float 12. The float attachment end 24 of the handle 22 preferably includes means for remotely adjusting the angle of, the float 12 relative to the handle 22, e.g., a conventional "Hustler Head" or other known conventional adjustment means as described further above in various patents noted in the Related Art. These various means generally comprise a mechanical linkage which converts rotary motion of the handle to linear motion, adjusting a link between the handle and float so the float rotates angularly relative to the handle about a pivot securing the float to the handle. The specific mechanism is not critical to the present invention, as various mechanisms providing this function are known.

A concrete texturing brush or broom 30 extends forwardly from the upper surface 14 of the float 12, or more precisely, from the lateral reinforcement 28 secured to the upper surface 14 of the float 12. A series of brackets connects the brush 30 adjustably to the float 12, with the lateral axis 32 of the brush always remaining parallel to the lateral axis 18 of the float regardless of attachment bracket adjustment. The brush attachment bracket assembly allows the user of the present tool 10 to adjust the position of the brush 30 relative to the float 12, with adjustment provided for the depth of the bristles 34 of the brush 30 relative to the lower surface 16 of the float 12, as well as the angular rake of the bristles 34 relative to the plane of the float 12.

The brush attachment bracket assembly comprises a series of four components, not including attachments. An elongate, laterally disposed float attachment bracket 36 has a base portion 38 affixed to the upper surface 14 of the float 12, or more accurately, to the brace member 28 atop the float 12, if the float 12 is so equipped. Opposite first and second upturned ends 40 extend from the opposite ends of the base portion 38, with the entire float attachment bracket 36 thus having a relatively wide, squared "U" shape.

An elongate, laterally disposed intermediate bracket 42 has a medial portion 44 with parallel, opposed first and second ends 46 extending therefrom, defining a shape similar to the bracket 36. The intermediate bracket first and second ends 46 attach to the respective float attachment bracket ends 40 by suitable fasteners through holes formed in the bracket component ends 40 and 46.

Finally, a pair of brush attachment arms 48 each have a brush attachment end 50 secured to a clamp 52, with the clamps 52 in turn being secured to the spine 54 of the brush or broom 30. The opposite intermediate bracket attachment ends 56 of the brush attachment arms 48 are adjustably secured to the end portions 46 of the intermediate bracket 42, adjacent the medial portion 44 thereof and opposite the end attachment points of the intermediate bracket ends 46 to the float attachment bracket ends 40. All of the bracket components 36, 42, and 48 may be formed of flat stock material, or other material as desired. Where flat stock is used, the two brush attachment arms 48 being formed with a 90 degree twist in order to position their intermediate bracket attachment ends 56 parallel to the planes of the opposite end members 46 of the intermediate bracket 42.

The above described bracket series 36, 42, and 48 are adjustably secured to one another by a corresponding series of threaded fasteners (e.g., bolts or screws 58 and wing nuts 60), enabling a user of the present tool 10 to adjust the angular relationships of the various bracket components 36, 42, and 48 to one another as desired, in order to position the broom or brush 30 relative to the float 12 as desired or required. Preferably, some form of hand manipulable fasteners, such as the wing nuts 60 shown, are used, in order to allow the user of the present tool 10 to adjust the angles of the various brackets 36, 42, and 48 by hand, without need for additional tools or equipment.

Figure 2:
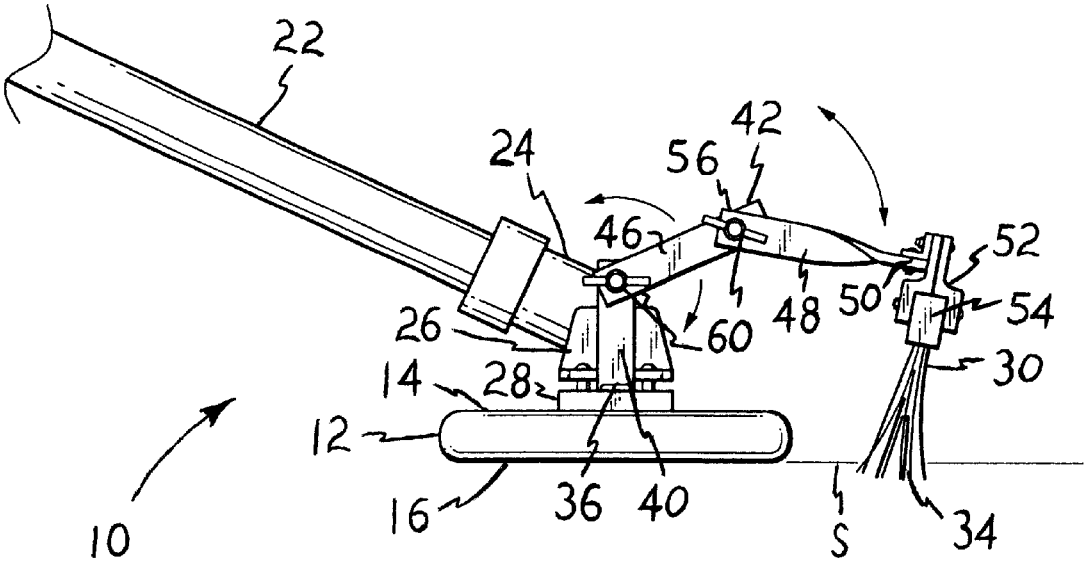
FIG. 2 is a side elevation view of a first embodiment of the float and brush working end of the present invention, showing the adjustability of the broom or brush attachment bracket therefor.
Figure 3:
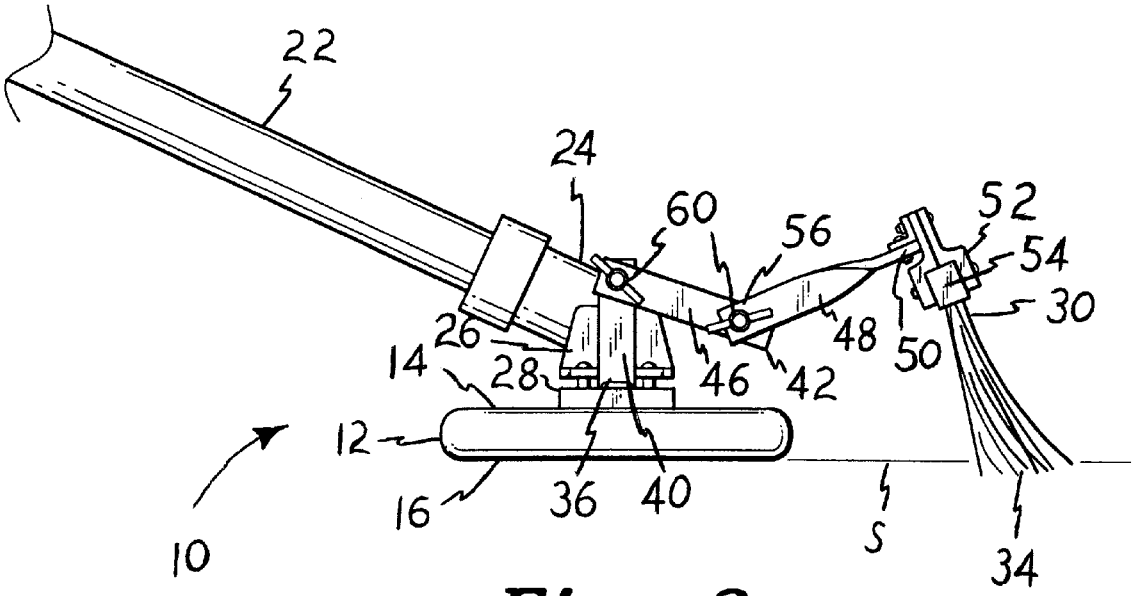
FIG. 3 is a second side elevation view of the first embodiment of the present invention, showing an alternative adjustment of the texturing or finishing brush or broom.

FIGS. 2 and 3 illustrate two exemplary adjustments of the above described brush attachment brackets 36, 42, and 48. In FIG. 2, the intermediate bracket 42 has been adjusted or rotated angularly upwardly about its attachment points with the flat attachment bracket 36, thus raising the two end arms 46 and the medial member 44 extending therebetween. As the attachment points for the intermediate bracket attachment ends 56 of the two brush or broom attachment arms 48 secure adjacent the raised ends of the two end components 46 of the intermediate bracket 42, their distal broom clamp attachment ends 50 must be lowered in order for the bristles 34 of the broom or brush 30 to contact the underlying surface S. This results in the brush attachment arms 48 being slightly lower at their brush attachment ends 50, with the broom or brush 30 assuming the nearly perpendicular orientation shown in FIG. 2, relative to the underlying surface S.

In FIG. 3, the intermediate bracket 42 has been lowered, thus lowering the medial crossmember 44 and the corresponding attach points for the intermediate attachment ends 56 of the two brush attachment arms 48. This results in the opposite brush attachment ends 50 of the two arms 48 being higher than their intermediate attachment ends, with the bristles 34 of the brush 30 assuming the angle shown in FIG. 3 relative to the underlying surface S. It will be seen that the adjustments described above permit the brush 30 to be adjusted not only angularly, but also vertically relative to the plane defined by the lower surface 16 of the float 12 and the underlying surface S.

Figure 4:
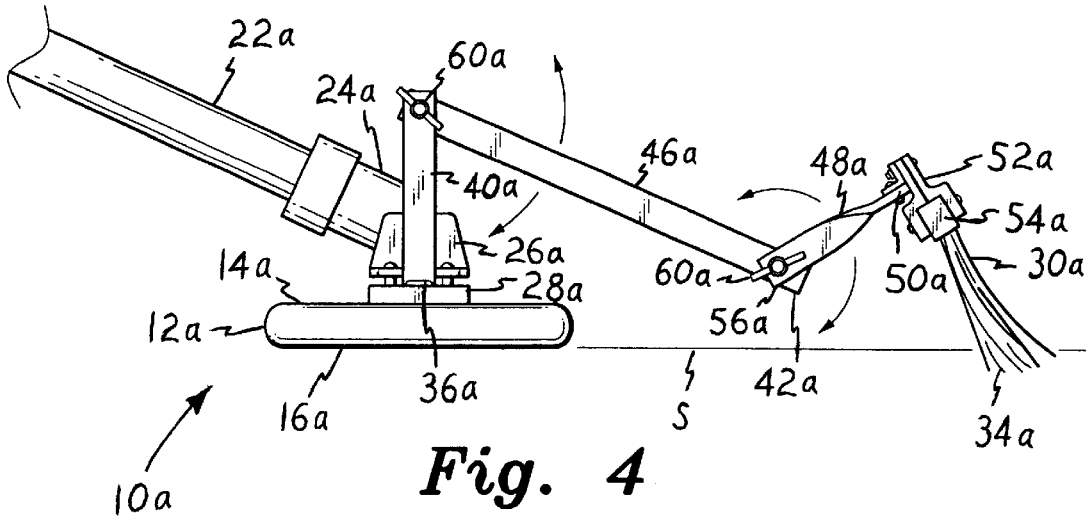
FIG. 4 is a side elevation view of a second embodiment of the present concrete finishing tool invention, having broom attachment arms of differing lengths than the first embodiment.
Figure 5:
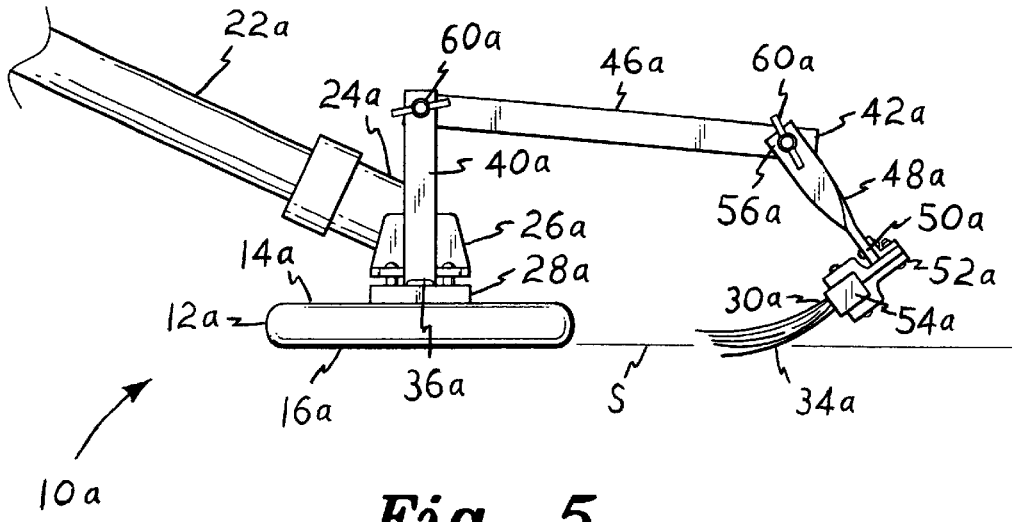
FIG. 5 is another side elevation view of the second embodiment, illustrating a different adjustment position for the brush or broom.

In FIGS. 1 through 3, the opposed end arms 46 of the intermediate bracket 42 and the two brush attachment arms 48 are substantially the same length. While this permits a wide range of adjustment to be made, in some instances it may be desirable to provide further angular adjustment for the brush or broom of the present concrete finishing tool. FIGS. 4 and 5 illustrate side elevation views of an alternative embodiment of the present tool incorporating bracket arms of different lengths, designated as concrete finishing tool 10*a*. The various components of the tool 10*a* of FIGS. 4 and 5 are essentially the same as the corresponding components of the tool 10 of FIGS. 1 through 3, excepting the lengths of the float attachment bracket end arms and intermediate bracket end arms, with corresponding components of the tool 10*a* being designated by the same numbers but including an "a" suffix.

The concrete finishing tool 10*a* of FIGS. 4 and 5 differs from the tool 10 only in the lengths of the opposed end arms or members of the float attachment bracket and intermediate bracket, as noted above. In FIGS. 4 and 5, the opposed end arms 40*a* of the float attachment bracket 36*a* are slightly longer than those corresponding arms or components 40 of the tool 10 of FIGS. 1 through 3. However, the greatest difference between the two tools 10 and 10*a* is in the lengths of the end arms of the intermediate bracket, with the first and second end arms or components 46*a* of the intermediate bracket 42*a* of the tool 10 of FIGS. 4 and 5, having a considerably greater length than the first and second end components 46 of the intermediate bracket 42 of the tool 10 of FIGS. 1 through 3.

This results in the first and second end components 46*a* of the intermediate bracket 42*a* being substantially longer than the two brush attachment arms 48*a* of the tool 10*a*, as shown clearly in FIGS. 4 and 5 of the drawings. This allows considerably greater angular adjustment of the two brush attachment arms 48*a* relative to the intermediate bracket end components 46*a* for the tool 10*a*, thus allowing the brush 34*a* to be angled or raked forwardly or rearwardly relative to the float 12*a* to a considerably greater degree with the tool 10*a*, than with the tool 10. This permits the brushed finish of the fresh, uncured concrete to be adjusted or formed as desired, even though the concrete is curing and changing its consistency and viscosity during the curing process as the brushing operation is being performed. The relatively long end arm components 46*a* provide considerably greater height adjustment for the brush or broom 30*a* of the tool 10*a* in comparison to those corresponding components of the tool 10, thus providing further versatility for the concrete finishing tool 10*a*.

In conclusion, the present concrete finishing tools 10 and 10*a* serve to greatly improve efficiency in concrete finishing work. Prior to the development of the present invention, tools used for brushing and texturing freshly poured concrete provided no adjustment whatsoever. As the penetration of the brush bristles into the fresh concrete is dependent upon the degree of cure of the concrete and corresponding consistency and viscosity, oftentimes it was necessary for a crew to wait after the concrete had been leveled and smoothed, before proceeding with brushing operations.

Obviously, such delays are inefficient and lead to greater costs incurred in a job, particularly where relatively highly paid and specialized union workers may be involved. With the use of the present concrete finishing tool, the bristles of the texturing brush or broom may be adjusted at a relatively shallow angle relative to the freshly poured and still quite soft concrete, in order to provide relatively shallow penetration in the soft surface immediately after the concrete has been smoothed after pouring. As the concrete continues to set and cure and it becomes more viscous, the worker may adjust the angle of the bristles to penetrate more deeply into the concrete surface, and/or at a steeper angle to the surface, thereby overcoming the greater resistance of the curing concrete and producing a consistent brushed texture or pattern over the entire surface of the concrete. Accordingly, the present invention will provide economies of operation which will result in a rapid payback and reduced costs in concrete construction projects, particularly where brushing is done to produce a textured finish on the surface of the concrete slab.

It is to be understood that the present invention is not limited to the embodiments described above, but encompasses any and all embodiments within the scope of the following claims.

I claim:

1. A concrete finishing tool, comprising:

a wide, flat, rigid float having at least an upper surface, a lower surface, and an elongate lateral axis;

an elongate handle having at least a float attachment end secured to said float;

a plurality of brush attachment brackets extending from said upper surface of said float wherein said plurality of brush attachment brackets comprises:

an elongate, laterally disposed float attachment bracket, having a base portion affixed to said upper surface of said float and opposed upturned first and second ends extending therefrom:

an elongate, laterally disposed intermediate bracket, having a medial portion and opposed parallel first and second ends extending therefrom;

said first and second ends of said intermediate bracket being angularly adjustably secured respectively to said first and second ends of said float attachment bracket; and a first and a second brush attachment arm, with each said arm having a brush attachment end secured to said brush and an opposite intermediate bracket attachment end angularly adjustably secured respectively to said first and second ends of said intermediate bracket adjacent said medial portion thereof;

a concrete texturing brush secured to said brush attachment brackets and extending therefrom said brush having an elongate lateral axis disposed parallel to said elongate lateral axis of said float; and said brush attachment brackets further including a bristle height and angular rake adjusting means for adjusting said brush height and angular rake relative to said lower surface of said float.

2. The concrete finishing tool according to claim 1, wherein said bristle height and angular rake adjusting means is manual and precludes any requirement for tools, having a plurality of wing nuts adjustably securing said intermediate bracket to said float attachment bracket and said first and second brush attachment arm to said intermediate bracket.

3. The concrete finishing tool according to claim 1, wherein:

said first and second ends of said intermediate bracket are substantially longer than said first and said second brush attachment arm, whereby;

said first and second ends of said intermediate bracket provide height adjusting means for said first and said second brush attachment arm and said brush attached thereto, with said first and said second brush attachment arm providing rake angle adjustment means for said brush attached thereto.

4. The concrete finishing tool according to claim 1, wherein said float attachment end of said handle further includes means for remotely angularly adjusting said float relative to said handle, by manipulating said handle.

5. The concrete finishing tool according to claim 1, wherein said float is substantially oval in shape, with rounded ends.

6. A concrete finishing tool, comprising:

a wide, flat, rigid float having at least an upper surface, a lower surface, and an elongate lateral axis;

an elongate handle having at least a float attachment end secured to said float;

said float attach end of said handle further including means for remotely angularly adjusting said float relative to said handle, by manipulating said handle;

a plurality of brush attachment brackets extending from said upper surface of said float wherein said plurality of brush attachment brackets comprises:

an elongate, laterally disposed float attachment bracket, having a base portion affixed to said upper surface of said float and opposed upturned first and second ends extending therefrom;

an elongate, laterally disposed intermediate bracket, having a medial portion and opposed parallel first and second ends extending therefrom;

said first and second ends of said intermediate bracket being angularly adjustably secured respectively to said first and second ends of said float attachment bracket; and a first and a second brush attachment arm, with each said arm having a brush attachment end secured to said brush and an opposite intermediate bracket attachment end angularly adjustably secured respectively to said first and second ends of said intermediate bracket adjacent said medial portion thereof;

a concrete texturing brush secured to said brush attachment brackets and extending therefrom;

said brush having an elongate lateral axis disposed parallel to said elongate lateral axis of said float; and said brush attachment brackets further including a bristle height and angular rake adjusting means for adjusting said brush height and angular rake relative to said lower surface of said float.

7. The concrete finishing tool according to claim 6, wherein said bristle height and angular rake adjusting means is manual and precludes any requirement for tools, having a plurality of wing nuts adjustably securing said intermediate bracket to said float attachment bracket and said first and second brush attachment arm to said intermediate bracket.

8. The concrete finishing tool according to claim 6, wherein:

said first and second ends of said intermediate bracket are substantially longer than said first and said second brush attachment arm, whereby;

said first and second ends of said intermediate bracket provide height adjusting means for said first and said second brush attachment arm and said brush attached thereto, with said first and said second brush attachment arm providing rake angle adjustment means for said brush attached thereto.

9. The concrete finishing tool according to claim 6, wherein said float is substantially oval in shape, with rounded ends.

10. A concrete finishing tool, comprising:

a wide, flat, rigid float having at least an upper surface, a lower surface, and an elongate lateral axis;

an elongate handle having at least a float attachment end secured to said float;

a plurality of brush attachment brackets extending from said upper surface of said float wherein said plurality of brush attachment brackets comprises:

an elongate, laterally disposed float attachment bracket, having a base portion affixed to said upper surface of said float and opposed upturned first and second ends extending therefrom;

an elongate, laterally disposed intermediate bracket, having a medial portion and opposed parallel first and second ends extending therefrom;

said first and second ends of said intermediate bracket being angularly adjustably secured respectively to said first and second ends of said float attachment bracket; and a first and a second brush attachment arm, with each said arm having a brush attachment end secured to said brush and an opposite intermediate bracket attachment end angularly adjustably secured respectively to said first and second ends of said intermediate bracket adjacent said medial portion thereof;

a concrete texturing brush secured to said brush attachment brackets and extending therefrom;

said brush having an elongate lateral axis disposed parallel to said elongate lateral axis of said float; and said brush attachment brackets further including manually adjustable bristle height and angular rake adjusting means for adjusting said brush height and angular rake relative to said lower surface of said float, precluding any requirement for tools.

11. The concrete finishing tool according to claim 10, wherein said manual bristle height and angular rake adjusting means comprises a plurality of manually manipulable wing nuts adjustably securing said intermediate bracket to said float attachment bracket and said first and second brush attachment arm to said intermediate bracket.

12. The concrete finishing tool according to claim 10, wherein:

said first and second ends of said intermediate bracket are substantially longer than said first and said second brush attachment arm, whereby;

said first and second ends of said intermediate bracket provide height adjusting means for said first and said second brush attachment arm and said brush attached thereto, with said first and said second brush attachment arm providing rake angle adjustment means for said brush attached thereto.

13. The concrete finishing tool according to claim 10, wherein said float attachment end of said handle further includes means for remotely angularly adjusting said float relative to said handle, by manipulating said handle.

14. The concrete finishing tool according to claim 10, wherein said float is substantially oval in shape, with rounded ends.

* * * * *